United States Patent [19]

Peterson

[11] 4,283,148

[45] Aug. 11, 1981

[54] APPARATUS AND METHOD FOR SOLID PARTICLE BULK DENSITY MEASUREMENTS

[75] Inventor: Richard W. Peterson, Lower Burrell, Pa.

[73] Assignee: Aluminum Company of America, Pittsburgh, Pa.

[21] Appl. No.: 56,802

[22] Filed: Jul. 12, 1979

[51] Int. Cl.[3] ..... B01F 9/00

[52] U.S. Cl. ..... 366/142; 366/108; 366/220; 73/32 R

[58] Field of Search ..... 366/213, 220, 232, 235, 366/233, 225, 228, 229, 230, 231, 142, 108; 73/32; 51/164.1; 33/126.7 A

[56] References Cited

U.S. PATENT DOCUMENTS

| | | | |
|---|---|---|---|
| 923,560 | 6/1909 | Mount | 73/32 |
| 1,844,153 | 2/1932 | Giryotas | 73/32 |
| 2,514,126 | 7/1950 | Fischer | 51/164.1 |
| 2,890,027 | 6/1959 | Fischer | 366/235 |
| 2,901,227 | 8/1959 | Russum | 366/235 |
| 3,170,677 | 2/1965 | Phister | 366/16 |
| 3,326,536 | 6/1967 | Zingg | 366/17 |

*Primary Examiner*—Robert W. Jenkins
*Attorney, Agent, or Firm*—Glenn E. Klepac

[57] ABSTRACT

Apparatus and method for blending together solid particles having different sizes into a homogeneous mass. A weighed quantity of solid particles of different sizes are inserted into a Y-shaped container which is closed off and rotated several times to blend the solid particles into a homogeneous mass. After blending, a scale is inserted into an elongated principal section of the container to determine bulk density of the mass.

5 Claims, 7 Drawing Figures

3 MINUTES
15 SECONDS
F
E
BULK DENSITY g cm-3
1.26
1.25
1.24
1.23
1.18
1.17
1.16
1.15
1.14
1.13
1.12
30
35
40
45
50
55
60
COARSE, %

C
B
A
BULK DENSITY g cm-3
1.03
1.02
1.01
1.00
.99
.98
.97
.96
.95
.94
30
35
40
45
50
55
60
COARSE, %

APPARATUS AND METHOD FOR SOLID PARTICLE BULK DENSITY MEASUREMENTS

BACKGROUND OF THE INVENTION

The present invention relates to an apparatus and method for blending solid particles, and for determining bulk density of a mass of such particles. The invention facilitates the blending of solid particles of coke used in manufacturing anodes for the electrolytic production of aluminum and other metals.

The present invention represents an improvement on the apparatus disclosed in J. J. Fischer U.S. Pat. No. 2,514,126 issued July 4, 1950. The Fischer patent discloses a generally V-shaped blending or mixing apparatus for blending or mixing solid particles. The device of the Fischer patent is presently being marketed under the trademark "TWIN-SHELL" by The Patterson-Kelley Co., Inc. of East Stroudsburg, Pa.

The apparatus of the Fischer patent is widely used in laboratories and in industry for mixing solids and liquids of many types. However, the V-shape of the Fischer apparatus requires that solid particles be removed from the blender in order to determine their bulk density.

An apparatus for determining density of granular or powdered materials is disclosed in W. D. Mount U.S. Pat. No. 923,560 issued June 1, 1909. However, the Mount apparatus is unsuitable for efficient mixing of solid particles. In order to adapt the Mount apparatus for bulk density measurements of the type performed by the apparatus of the present invention, it is necessary to mix the solid particles in a separate blender and then transfer them to the Mount apparatus.

SUMMARY OF THE INVENTION

It is a principal object of the present invention to provide an apparatus and method for blending a multiplicity of solid particles into a homogeneous mass, and for measuring bulk density of the mass without removing the particles from their container.

It is a related object of the invention to provide a novel Y-shaped container for blending together a multiplicity of solid particles having a plurality of different particle sizes.

Another object of the invention is to provide a mixing apparatus yielding a more thorough blend of solid particles of different particle size ranges than conventional blenders.

The foregoing objectives of my invention are accomplished by providing an apparatus for blending a preweighed quantity of solid particles comprising a generally Y-shaped container having a pivot means attached thereto. The container includes an elongated hollow principal section and two hollow leg sections attached to an end portion of the principal section.

In a preferred embodiment, bulk density of a mass of solid particles is determined by inserting a tubular scale into an aperture of the container to abut against the mass of particles. Because bulk density is inversely related to the volume of a given weight of solid particles, the scale is calibrated to provide a directed reading of bulk density. In an alternative embodiment, bulk density is measured by passing a beam of ionizing radiation through the mass of blended particles, and by detecting the degree of attenuation of the beam.

Additional advantages of the present invention will become apparent to persons skilled in the art from the following specification taken in conjunction with the drawings.

BRIEF DESCRIPTION OF THE PREFERRED EMBODIMENTS

Figure 1:
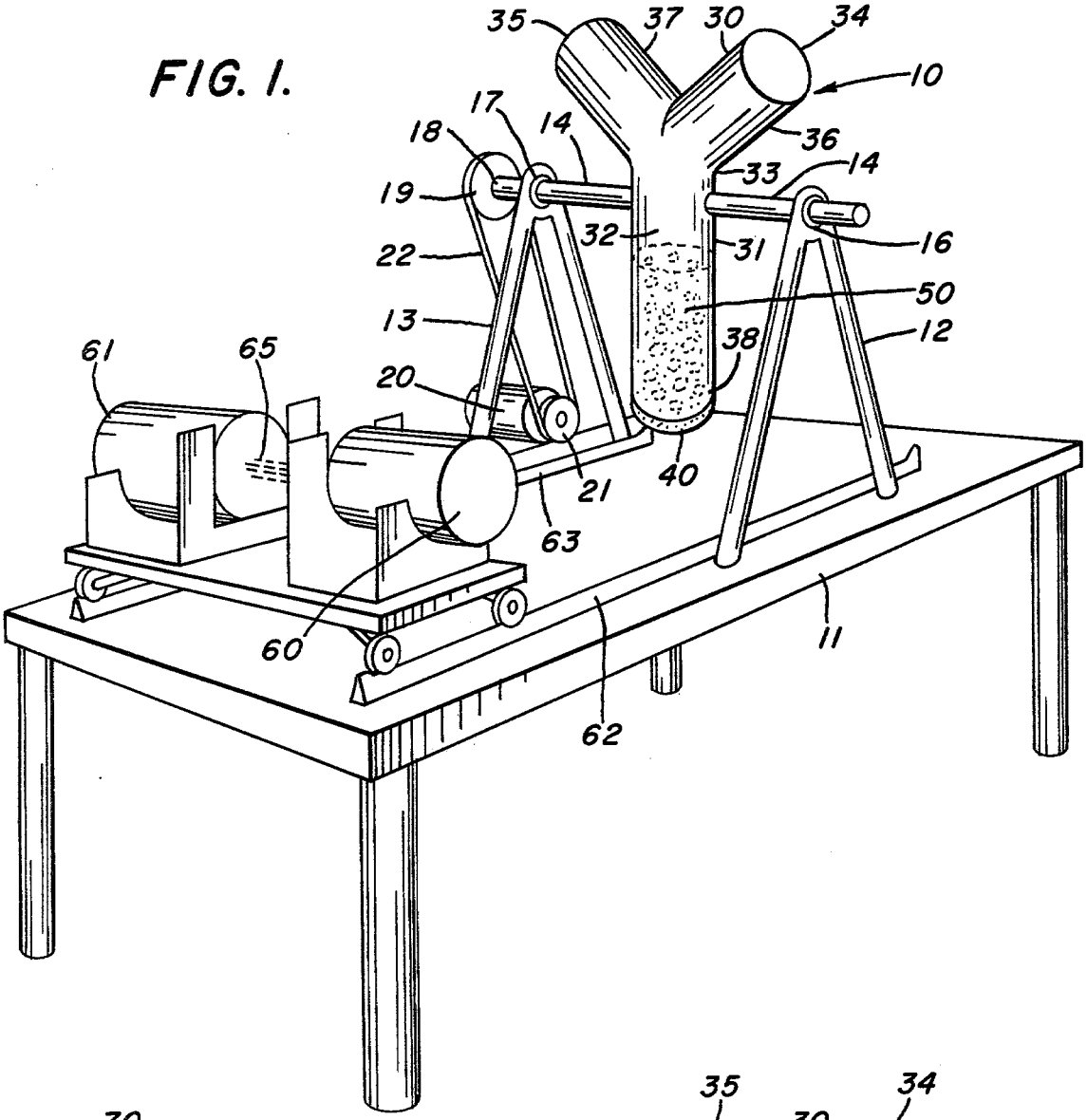
FIG. 1 is a front perspective view of a Y-shaped blending apparatus of the invention, wherein bulk density of a mass of solid particles is determined by measuring the attenuation of a beam of ionizing radiation.

There is shown in FIG. 1 a blending apparatus 10 of the invention mounted upon a table 11. A pair of triangular, laterally spaced mounting brackets 12, 13 suspends a pivot means or rod 14 horizontally above a horizontal surface of the table 11. Lateral end portions of the rod 14 are inserted through respective bushings 16, 17 in the mounting brackets 12, 13. A free end portion 18 of the rod 14 is affixed to a pulley 19.

An electric motor 20 is connected to the rod pulley 19 through a motor pulley 21 and fan belt 22. When the motor 20 is energized, the rod 14 is rotated.

It is an important feature of the present invention that the blending apparatus 10 comprises a generally Y-shaped hollow container 30. The container 30 includes an elongated hollow principal section 31 enclosing an elongated compartment 32. A first end portion 33 of the principal section 31 is attached to a hollow first leg section 34 and a second leg section 35. The first leg section 34 encloses a first chamber 36 communicating with the compartment 32 in the principal section and with a second chamber 37 in the second leg section 35.

The principal section 31 includes a second end portion 38 opposed to the first end portion 33. This second end portion 38 is closed off by a removable lid 40. The lid 40 is removed from the second end portion 38 for entry and exit of solid particles with respect to the container 30. End portions of the leg sections 34, 35 opposed to the second end portions 38 are closed off to retain particles within the container 30.

The first leg section 34 and second leg section 35 each diverge from the principal section at an obtuse angle. The first leg section 34 and second leg section 35 lie in the same plane, and they may diverge from one another at an angle of between about 45° and 135°. In each of the preferred embodiments illustrated in FIGS. 1–3, the angle between an axis defined by the first leg section and an axis defined by the second leg section is about 90°.

In the embodiment of FIG. 1, a mixture or homogeneous mass 50 of solid carbon particles of varying sizes is retained at the bottom of the principal section 31. Bulk density of the mass 50 has been found to be proportional to the degree of attenuation of a beam of ionizing radiation emitted by a source 60. After the container has been rotated several times to homogenize the mass of solid particles 50, the source 60 and detector 61 are wheeled along tracks 62, 63 to locate the source 60 and detector 61 on opposed sides of the principal section 31. In the preferred embodiment illustrated, the source 60 comprises 500 millicuries of Cesium-137, the detector 61 is an ionization chamber, and the beam 65 emitted by the source 50 includes both electrons and gamma rays. Other preferred radiation sources and radiation detection means may be substituted without impairing effectiveness of the invention.

Figure 2:
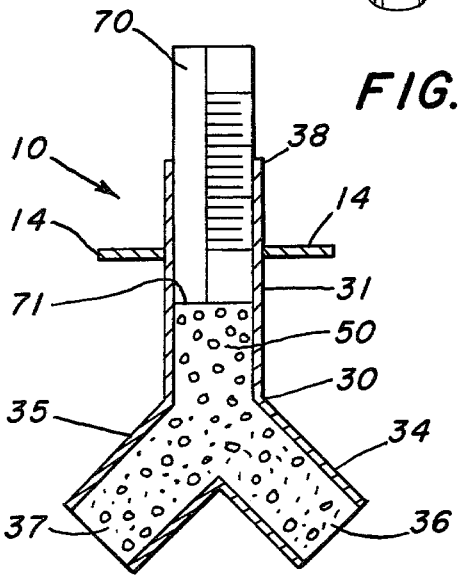
FIG. 2 is a fragmentary, front cross-sectional view of a second embodiment of the Y-shaped blending apparatus of the invention.

A second embodiment of the blending and bulk density measuring apparatus 10 is illustrated in FIG. 2. Here, a preweighed mass 50 of solid particles is made homogeneous by pivoting the container 30 several times about a pivot means or rods 14, as in the FIG. 1 embodiment. After the particles have been mixed, the lid is removed to expose an aperture in the top or second end portion 38. An elongated generally cylindrical scale 70 is inserted through the aperture to abut a bottom end portion 71 of the scale against an upper surface portion of the mass 50 of solid particles. The scale 70 is calibrated to provide direct readings of bulk density.

If desired, the blended mass 50 of solid particles may be compacted by radially rotating the bottom end portion 71 of the scale while in contact with the upper surface portion of the particles, thereby to compact the mass 50. The mass 50 may also be compacted by vibrating the container 30 prior to insertion of the scale 70.

Figure 3:
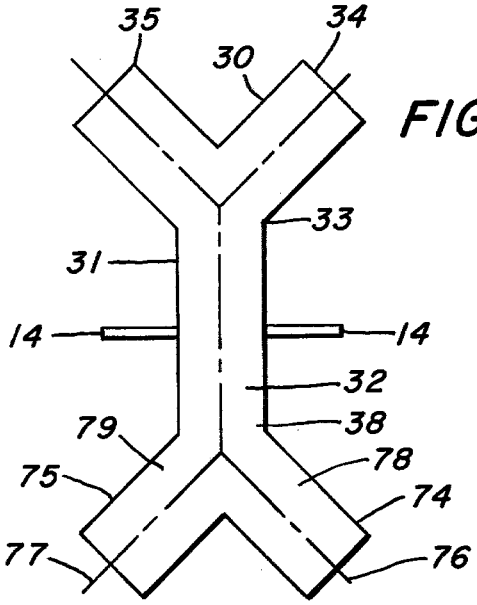
FIG. 3 is a fragmentary, schematic front elevational view of a third embodiment of the blending apparatus of the invention.

A third embodiment of the invention is illustrated in FIG. 3, wherein the container 30 is in the form of a pair of Y's having base portions affixed to one another. A first leg section 34 and a second leg portion 35 extend outwardly of the principal section 31, as in the other embodiments. In addition, a hollow third leg section 74 and a hollow fourth leg section 75 are attached to the second end portion 38 of the principal section 31. The third leg section 74 and fourth leg section 75 extend radially outwardly of the principal section 31 at an obtuse angle thereto. The third leg section 74 and fourth leg section 75 lie in the same plane, and they diverge from one another at an angle of less than 180°. In the preferred embodiment illustrated in FIG. 3, the angle between an axis 76 defined by the third leg section 74 and an axis 77 defined by the fourth leg section 75 is about 90°. The compartment 32 in the principal section 31, a third chamber 78 in the third leg section 74, and a fourth chamber 79 in the fourth leg section 75 are in communication with one another.

EXAMPLES

Figure 7:
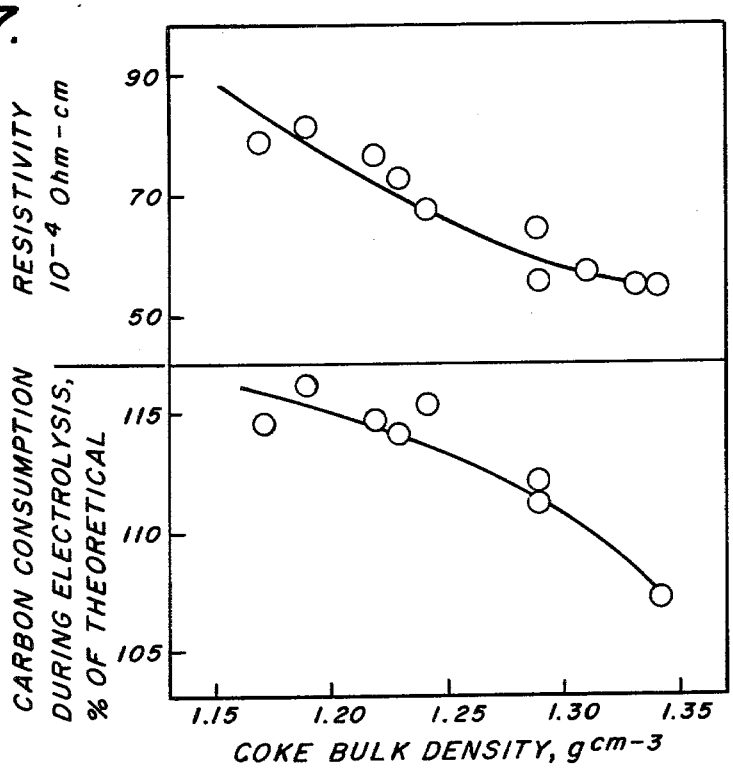
FIG. 7 is a graph of the resistivity and carbon consumption during electrolysis of an anode for electrolytic production of aluminum, as a function of the bulk density of coke particles used in manufacturing the anode.

It is well known in the aluminum industry that the quality of carbon anodes can be optimized by manufacturing the anodes with a mixture of coke particles having a high bulk density. In FIG. 7, it is shown that both resistivity and carbon consumption during electrolysis decrease as a function of the bulk density of coke particles used as raw materials for the anodes (D. Belitskus, "Optimization of Raw Materials and Formulations for Hall-Heroult Cell Electrodes", III Yugoslav Symposium on Aluminium, 1, 135 (1978)). Carbon anodes are continuously being consumed during the electrolysis of alumina to form a molten aluminum metal. Accordingly, the manufacture of carbon anodes to replace those being consumed has become a large-scale enterprise. In order to enhance the properties of the anodes and to insure their longevity, it is desirable to have available a method and apparatus for quick determination of coke particle bulk density so that adequate control is maintained over the raw materials.

In accordance with the invention, 2400 grams of coke particles having varying sizes are inserted through an aperture in an open end 38 of a container 31. A lid 40 then seals the aperture, and the container 31 is rotated about a pivot means 14 for several minutes to insure mixing of the particles 50 into a homogeneous mass.

After mixing has been completed, the lid 40 is removed and a scale 70 is inserted through the aperture. A bottom end portion 71 of the scale 70 abuts against a top surface of the particles 50. Bulk density is read directly from the scale 70 at the rim of the upper end 38 of the container 31.

Figure 6:
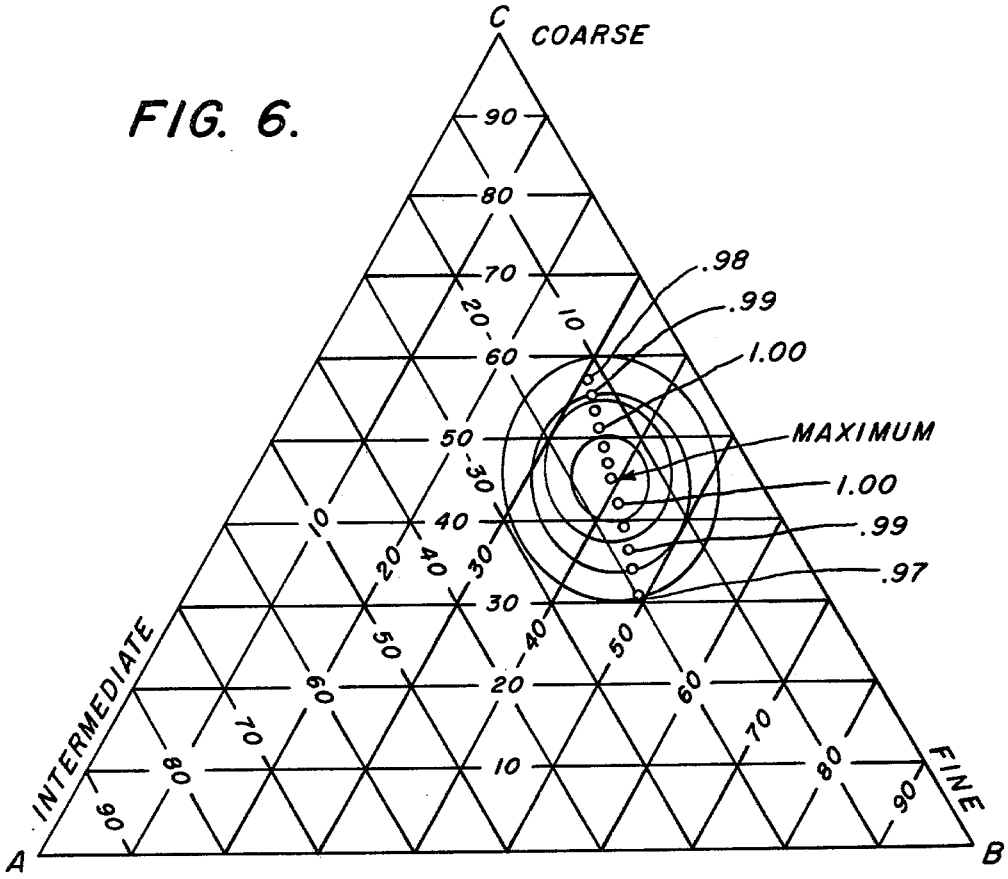
FIG. 6 is a triangular graph of the bulk density of a mass of coke particles, as a function of the percentages of intermediate, coarse, and fine particles in the mass.

FIG. 6 shows the bulk density of a mass of coke particles as a function of the percentages of coarse, intermediate and fine particles contained in the mass.

Percentages by weight of various sieve size fractions in each of the coarse, intermediate and fine coke particle mixtures are provided in Table I.

TABLE I

COMPOSITION OF COARSE, INTERMEDIATE AND FINE COKE PARTICLE MIXTURES, IN PERCENTAGE BY WEIGHT PER SIZE RANGE

| Sieve Size, Tyler Sieve Series | Percentage by Weight in Size Range | | |
|---|---|---|---|
| | Coarse | Intermediate | Fine |
| +4 | .63% | 0% | 0% |
| −4 +8 | 15.93% | .03% | 0% |
| −8 +14 | 51.52% | .43% | 0% |
| −14 +28 | 30.18% | 18.71% | .10% |
| −28 +48 | 1.48% | 51.84% | 1.56% |
| −48 +100 | .13% | 21.81% | 10.60% |
| −100 +200 | .05% | 6.15% | 26.88% |
| −200 | .08% | 1.03% | 60.86% |

In FIG. 6, the density of the mass particles having highest bulk density is about 1.01 grams/cubic centimeter, and the mass contains approximately 39% fine particles, 45% coarse particles and 16% intermediate particles.

Figure 5:
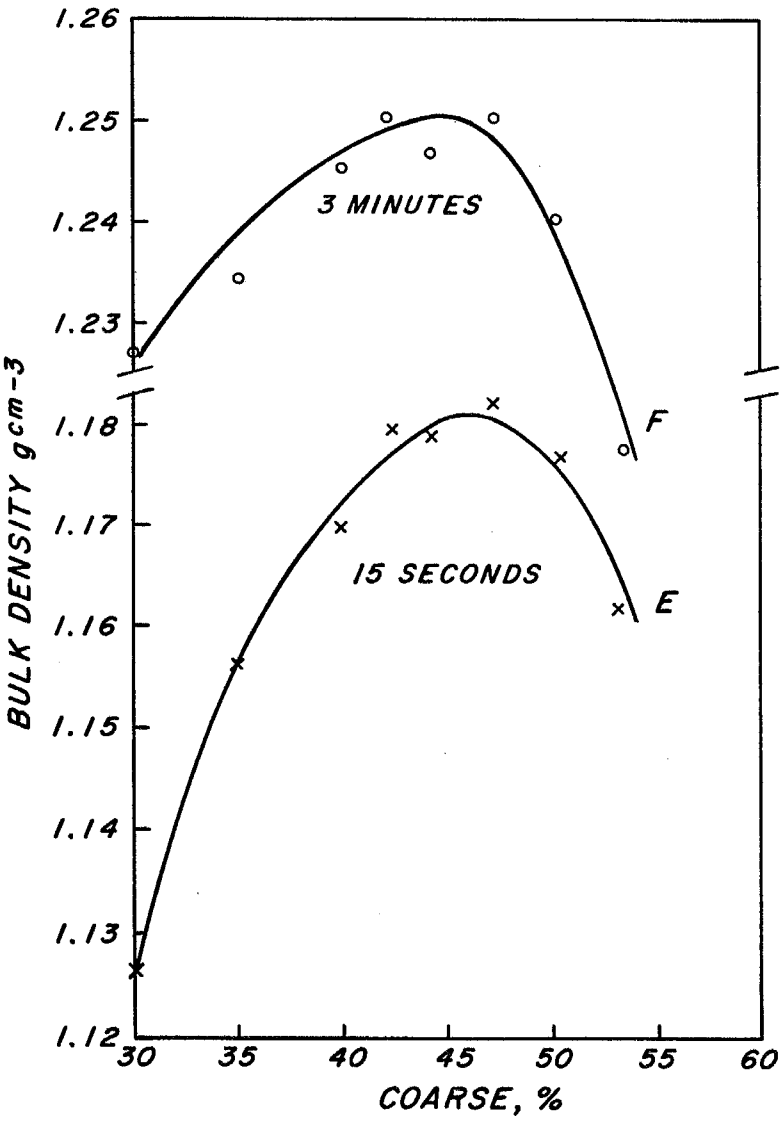
FIG. 5 is another graph of the bulk density of a mass of carbon particles which has been vibrated for varying periods of time, as a function of the percentage of coarse particles in the mass.
Figure 4:
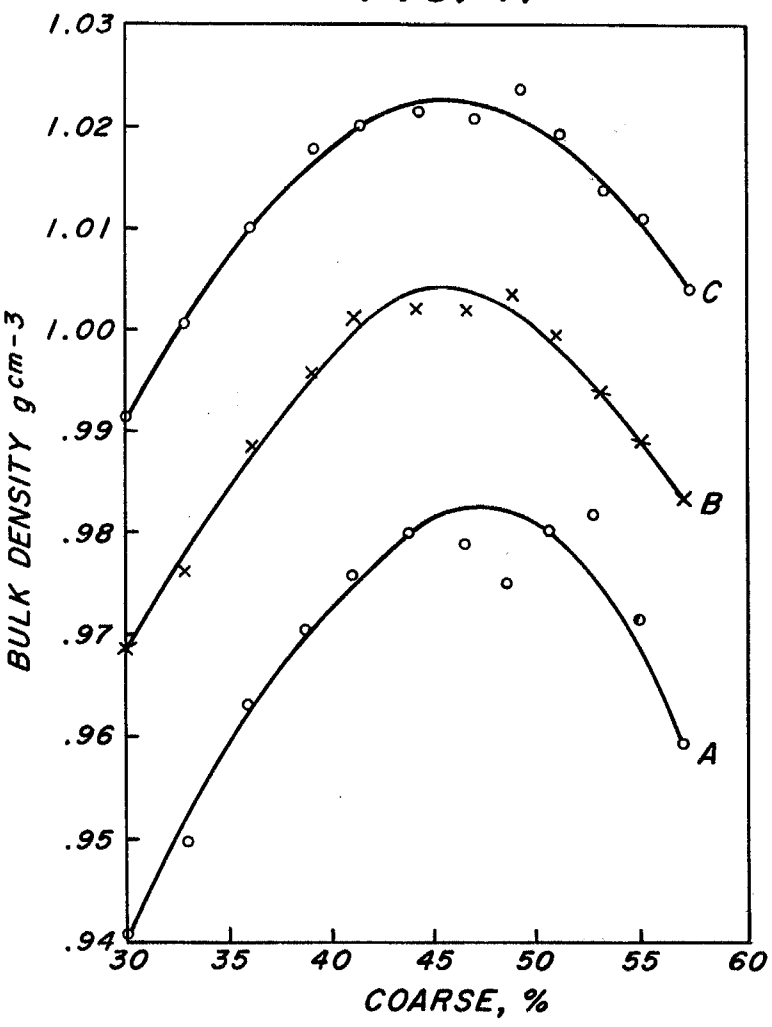
FIG. 4 is a graph of the bulk density of a mass of particles of coke, as a function of the percentage of coarse particles in the mass.

In compiling the data of FIGS. 4 and 5, the percentage of coarse particles was varied. An initial 2400 gram mass of coke particles placed in the blender contained 30% coarse particles, 20% intermediate, and 50% fine. After each bulk density measurement, 100 grams of blended coke particles were removed and replaced with 100 grams of coarse coke particles.

In curve A of FIG. 4, the tubular scale 70 was placed gently on top of the coke mass 50, and a reading was taken. In curve B of FIG. 4, the scale 70 was rotated radially while in contact with the coke particles 50 to level off the mass. In curve C, the container 31 was tapped with a hammer while a bottom end portion 71 of the scale was in contact with the coke particles 50. It can be observed in FIG. 4 that while bulk density varies greatly depending upon how measurements are made, in each set of measurements the percentage of coarse particles needed to obtain maximum bulk density remained nearly constant at approximately 45%.

In curve E of FIG. 5, the coke particles 50 were vibrated for 15 seconds after mixing and before measuring bulk density. In curve F, the particles 50 were vibrated for three minutes prior to measuring bulk density. Again, while bulk density increased with vibration time, the percentage of coarse particles needed to achieve maximum bulk density stayed constant at approximately 45%.

The foregoing description of my invention has been made with reference to several preferred embodiments. Persons skilled in the art will understand that numerous changes and modifications may be made therein without departing from the spirit and scope of the invention as defined in the following claims.

What is claimed is:

1. Apparatus for blending a multiplicity of solid particles having a plurality of different particle sizes into a homogeneous mass, comprising:

(a) a container including (i) an elongated hollow principal section enclosing an elongated compartment, said principal section having a first end portion and a second end portion opposed to said first end portion;

(ii) a hollow first leg section attached to the first end portion of the principal section and extending axially and radially outwardly thereof at an obtuse angle to the principal section, said first leg section enclosing a first chamber communicating with the compartment in the principal section;

(iii) a hollow second leg section attached to the first end portion of the principal section and extending axially and radially outwardly thereof at an obtuse angle to the principal section, said second leg section enclosing a second chamber communicating with the first chamber in the first leg section and with the compartment in the principal section;

(iv) a hollow third leg section attached to the second end portion of the principal section and extending axially and radially outwardly thereof at an obtuse angle to the principal section, said third leg section enclosing a chamber communicating with the compartment in the principal section; and (v) a hollow fourth leg section attached to the second end portion of the principal section and extending axially and radially outwardly thereof at an obtuse angle to the principal section, said fourth leg section diverging from the third leg section at an angle of less than 180°, said fourth leg section enclosing a chamber communicating with the chamber in the third leg section and with the compartment in the principal section; and (b) pivot means attached to the container, said container being rotatable about said pivot means to blend a multiplicity of solid particles contained therein into a homogeneous mass.

2. The apparatus of claim 1 wherein the angle between an axis defined by the third leg section and an axis defined by the fourth leg section is about 90°.

3. A method for blending into a homogeneous mass a multiplicity of solid particles having a preweighed mass and a plurality of different particle sizes, and for measuring the bulk density of the homogeneous mass, comprising the steps of:

(a) introducing a multiplicity of solid particles into a generally Y-shaped container having an elongated hollow principal section including a first end portion, a second end portion opposed to said first end portion and defining an aperture, a hollow first leg section attached to said first end portion, and a hollow second leg section attached to said first end portion and diverging from the first leg section at an angle of less than 180°;

(b) rotating said container about a pivot means attached thereto, thereby to blend the solid particles into a homogeneous mass;

(c) opening the second end portion of the principal section;

(d) maintaining the particles in the container upon opening the second end portion, and supporting the container with the principal section in an upright generally vertical attitude and with said second end portion being spaced upwardly of said first end portion;

(e) inserting an elongated scale through the aperture in the second end portion to abut a bottom end portion of the scale against an upper surface portion of the mass of solid particles; and (f) measuring the length of insertion of the scale in said container, said length being inversely related to the volume of said mass of solid particles and directly related to the bulk density thereof.

4. The method of claim 3 further comprising vibrating the container to compact the mass of solid particles prior to measuring the length of insertion of the scale.

5. The method of claim 3 further comprising rotating the bottom end portion of the scale radially to compact the mass of solid particles prior to measuring the length of insertion of the scale.

* * * * *